US006076909A

United States Patent [19]

Saeki et al.

[11] Patent Number: 6,076,909

[45] Date of Patent: Jun. 20, 2000

[54] GAP ADJUSTING DEVICE FOR A PRINT HEAD USED IN AN INK JET RECORDING APPARATUS AND GAP ADJUSTING METHOD

[75] Inventors: Tomoya Saeki; Tadashi Mizoguchi; Junichi Suetsugu; Hitoshi Minemoto; Hitoshi Takemoto; Kazuo Shima; Yoshihiro Hagiwara; Toru Yakushiji, all of Niigata, Japan

[73] Assignee: NEC Corporation, Japan

[21] Appl. No.: 09/034,446

[22] Filed: Mar. 4, 1998

[30] Foreign Application Priority Data

Mar. 4, 1997 [JP] Japan ..... 9-048940

[51] Int. Cl.[7] ..... B41J 25/308

[52] U.S. Cl. ..... 347/8

[58] Field of Search ..... 347/8; 400/55, 400/56, 57, 59, 708.1

[56] References Cited

U.S. PATENT DOCUMENTS

| | | | |
|---|---|---|---|
| 5,078,517 | 1/1992 | Hiroshi et al. | 400/59 |
| 5,474,391 | 12/1995 | Andou et al. | 400/55 |
| 5,518,323 | 5/1996 | Sakaino et al. | 400/55 |

FOREIGN PATENT DOCUMENTS

| | | |
|---|---|---|
| 2-056633 | 4/1990 | Japan . |
| 2-217278 | 8/1990 | Japan . |
| 55079342 | 11/1990 | Japan . |
| 4-247975 | 9/1992 | Japan . |
| 6-227085 | 8/1994 | Japan . |
| 7-276737 | 10/1995 | Japan . |
| 8-309993 | 11/1996 | Japan . |
| 10000805 | 1/1998 | Japan . |
| 93/11866 | 6/1993 | WIPO . |

*Primary Examiner*—Matthew S. Smith
*Attorney, Agent, or Firm*—Ostrolenk, Faber, Gerb & Soffen, LLP

[57] ABSTRACT

A capacitance is detected between an ejecting electrode and an opposite electrode by a capacitance detecting circuit with a recording medium placed on the opposite electrode. An electric field strength in the ejecting electrode is calculated by a gap adjustment control circuit based upon the detected capacitance. A motor driving circuit is controlled so that the electric field strength is set to a preset value. A lead screw coupled to the ejecting electrode is rotated by a motor and a gap between the ejecting electrode and the opposite electrode is thereby adjusted. Even if the thickness of a used recording medium changes, the ejecting electric field strength is kept stable and the recording quality is stabilized.

17 Claims, 3 Drawing Sheets

GAP ADJUSTING DEVICE FOR A PRINT HEAD USED IN AN INK JET RECORDING APPARATUS AND GAP ADJUSTING METHOD

BACKGROUND OF THE INVENTION

1. Field of the Invention

The present invention relates to a gap adjusting device of an ink jet printing head for adjusting a gap in which a recording medium passes, and more relates to a gap adjusting device for adjusting the gap between the ink jet printing head and an opposite electrode facing the print head and to a gap adjusting method.

2. Description of the Prior Art

In a conventional ink jet recording apparatus, in a method of applying pressure to ink by a piezoelectric element, a recording method called thermal ink jet (bubble jet) and an electrostatic ink jet printing method are generally known as ink jet recording operations. In these recording methods, it is important to keep a fixed gap (a head gap) between a head and a recording medium.

Specifically, an electrostatic ink jet recording apparatus is different from other ink jet recording apparatuses because an opposite electrode is used in front of the print head via a gap for giving an electric field in the gap. For example, in the electrostatic ink jet recording apparatus as described in WO93/11866 and Japanese published unexamined patent application No. H8-309993 published on Nov. 26, 1996, an ejecting electrode is provided to the print head and a recording paper is arranged between the opposite electrode and the ejecting electrode.

Further, in the electrostatic ink jet recording apparatus, electrified toner particles exist in the ink, and they are distributed in an insulating ink solvent. When a high-voltage pulse with the same polarity as the toner particles is applied to the ejecting electrode, the toner particles are ejected as an ink dot toward the opposite electrode which is separated by fixed distance (gap) from the ejecting part of the print head. The toner particles are ejected when an electric field strength between the ejecting electrode and the opposite electrode exceeds a threshold value. The electric field strength between the ejecting electrode and the recording medium is approximately expressed by the following expression (1):

$$E1=\Delta V1/d1. \tag{1}$$

E1: Electric field strength between the ejecting electrode and the opposite electrode ΔV1: Potential difference between the ejecting electrode and the recording medium d1: Distance between the ejecting electrode and recording medium If the thickness of the recording medium is d2, and a recording distance between the print head and the recording medium is d1, the following equation is established:

$$\Delta V1\epsilon 1S/d1=\Delta V2\epsilon 2S/d2 \tag{2-1}$$

$$\Delta V=\Delta V1+\Delta V2. \tag{2—2}$$

ΔV1: Potential difference in distance of d1

ΔV2: Potential difference in distance of d2

ΔV: Potential difference in distance of d1+d2 (the gap between the ejecting electrode and the opposite electrode)

ϵ1: Permittivity of air

ϵ2: Permittivity of recording medium

S: Area of the electrode part between the ejecting electrode and the opposite electrode Therefore, the electric field strength E1 between the ejecting electrode and the recording medium is inserted is established by the following expression:

$$E1=\Delta V1/d1$$
$$=\Delta V/\{d1+(\epsilon 1d2/\epsilon 2)\}. \tag{3}$$

E1: Electric field strength in distance of d1

In the conventional type electrostatic ink jet recording apparatus, if the thickness and the permittivity of the paper are different, the recording gap d1 between the ejecting electrode and the recording electrode changes. Hereby, electric field strength E1 between the ejecting electrode and the recording medium is changed and ink ejecting operation on the recording medium becomes unstable due to the change.

A gap adjusting device for detecting and correcting the distance between the surface of paper and a print head is disclosed in Japanese published unexamined patent application No. H4-247975 published on Sep. 3, 1992. The above gap adjusting device mechanically keeps the distance between the surface of paper and the end of a print head fixed; however, the mechanical adjustment is executed manually, and it is difficult to adjust the gap exactly.

Another gap adjusting device for detecting and correcting the distance between the surface of a paper and a print head is disclosed in Japanese published unexamined patent application No. H2-217278 published on Aug. 30, 1990. In the gap adjusting device, an optical sensor detects a gap between the end of a print head and the surface of the recording paper. A gap control device adjusts the gap based upon the detected result from the optical sensor and controls the print head so that an optimum gap is always held.

However, as the gap adjusting device detects only a gap between the surface of paper and the end of a print head, it cannot solve the change of electric field strength caused by the above change of the thickness and the permittivity of the paper. Therefore, the gap adjusting device described in the Japanese published unexamined patent application No. H2-217278 cannot be applied to an electrostatic ink jet recording apparatus.

Further, a gap adjusting device for detecting the thickness of paper and controlling a gap between the surface of paper and the end of a head is also disclosed in Japanese published unexamined utility model application No. H2-56633 published on Apr. 24, 1990. The gap adjusting device detects the thickness of paper and adjusts a gap between a print head and an opposite electrode based upon the detected result.

However, this gap adjusting device does not measure a gap between an ejecting electrode and the opposite electrode and does not correct the change of electric field strength E1 caused by the variation of the thickness and permittivity of the paper. Moreover, a specific mechanism for detecting the thickness of paper is required, and the mechanism is complicated and becomes expensive.

The whole conventional gap adjusting devices have a problem that they are not effective enough to prevent ink ejecting force from changing in a recording apparatus utilizing the electrostatic ink jet recording method.

As described above, in the electrostatic ink jet recording method, electric field strength between an ejecting electrode and the recording medium is an important parameter to eject toner and for stable ejecting, the electric field strength is required to be kept stable independent of the thickness of recording paper.

SUMMARY OF THE INVENTION

The object of the present invention is to provide a print head gap adjusting device and method for realizing an electrostatic ink jet recording apparatus in which the ejecting electric field strength between an ejecting electrode and the recording medium is kept stable and the recording quality is stable.

The print head gap adjusting device according to the present invention is used in an ink jet recording apparatus which ejects an ink dot from a print head to a recording medium placed in a gap between an ejecting electrode formed in the print head and an opposite electrode by supplying an electric field between the gap. The adjusting device includes a detecting circuit for detecting a capacitance between the ejecting electrode of the head and the opposite electrode, and an adjusting circuit for adjusting the gap on the basis of a detected capacitance detected by the detecting circuit.

The adjusting circuit has a moving device for moving the print head in a direction for causing the gap to be varied, and a control circuit for controlling the moving device on the basis of the detected capacitance.

The control circuit calculates an electric field strength between the ejecting electrode and the recording medium on the basis of the detected capacitance and controls the moving device such that the electric field strength becomes a desired value.

Further, according to the present invention, a method for adjusting a gap between an ejecting electrode of a print head and an opposite electrode used in an ink jet recording apparatus is provided. In the ink jet recording apparatus which ejects an ink dot from said print head to a recording medium placed in the gap by supplying an electric field between the gap, the method has the steps of detecting a capacitance between the ejecting electrode and the opposite electrode, and adjusting the gap on the basis of a detected capacitance.

DETAILED DESCRIPTION OF THE PREFERRED EMBODIMENT

Figure 1:
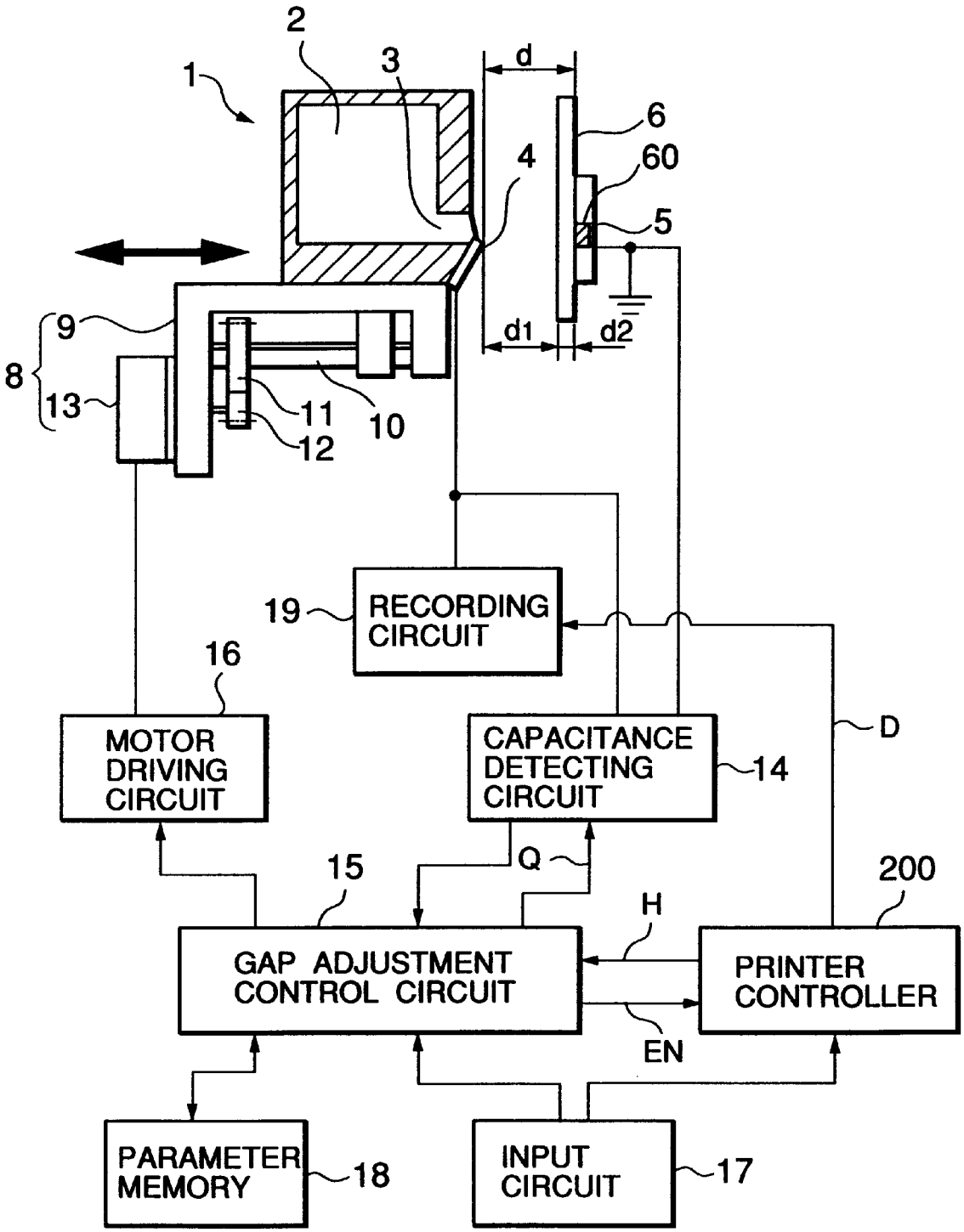
FIG. 1 is a schematic drawing showing an electrostatic ink jet recording apparatus provided with a gap adjusting device according to the present invention.

In FIG. 1, an electrostatic ink jet recording apparatus is provided with a print head 1, an opposite electrode 5 opposite to the print head 1 via a gap and a gap adjusting device shown generally at 100.

The print head 1 is constituted by an ink chamber 2 for storing ink 20, an ejecting outlet 3 for ejecting ink and an ejecting electrode 4 formed in the ejecting outlet 3. The ink 20 is dielectric ink including electrified toner particles which are electrified with positive polarity. A recording circuit 19 supplies high voltage for ejecting ink to the ejecting electrode 4. The high voltage has the polarity similar to that of the toner particles. The high voltage is generated in the recording circuit 19 according to printing data supplied from a printer controller 200.

The opposite the electrode 5 is grounded, thus, electric field strength between the ejecting electrode 4 and the opposite electrode 5 is determined by the high voltage supplied from the recording circuit 19.

The toner particles in the ink 20 are ejected from the ejecting part 3 as an ink dot while the strength of an electric field is formed between the ejecting electrode and the opposite electrode 5 by the high voltage applied to the ejecting electrode 4, and form an image on a recording medium 6 on the opposite electrode 5. The recording medium 6 is carried on the opposite electrode by a carrying roller (not shown).

The gap adjusting device 100 is connected to the print head 1, the opposite electrode 5 and the printer controller 200. The gap adjusting device 100 is provided with an capacitance detecting circuit 14 for detecting capacitance between the ejecting electrode 4 and the opposite electrode 5, a gap adjustment control circuit 15 for generating a motor control signal for adjusting the gap between the ejecting electrode 4 and the opposite electrode 5 based upon detected capacitance, an input circuit 17, a parameter memory 18, a motor driving circuit 16 and a gap adjusting mechanism 8 including a motor 13.

A gap adjustment mechanism 8 is a moving device for moving the print head 1 in a direction for causing a gap between the ejecting electrode 4 and the opposite electrode 5 to be varied. The gap adjusting device 100 controls the gap adjustment mechanism 8 such that an electric field strength between the ejecting electrode 4 and the recording medium 6 becomes a desired value.

In the gap adjusting device 100, the capacitance detecting circuit 14 detects capacitance instead of detecting distance (gap) between the ejecting electrode 4 and the opposite electrode 5.

Generally, the capacitance of a parallel-plate capacitor is expressed by the following expression (4):

$$C=\epsilon S/d. \tag{4}$$

$\epsilon$: Permittivity of air

S: Area of electrode plate d: Distance between the ejecting electrode 4 and opposite electrode 5

Therefore, the capacitance detecting circuit 14 can detect the capacitance between the ejecting electrode 4 and the opposite electrode 5 indirectly instead of measuring the gap between the ejecting electrode 4 and the opposite electrode 5. The area S of an electrode plate is the area of a part of the ejecting electrode 4 opposite to the opposite electrode 5.

In the above description, it is assumed that the gap between the ejecting electrode 4 and the opposite electrode 5 is provided with even permittivity. However, in actual printing, the recording medium 6 is inserted between the ejecting electrode 4 and the opposite electrode 5. In the above state, two types of parallel-plate capacitors can be considered connected in series and the capacitance C is expressed by the following expressions (5-1) and (5-2):

$$C=1/(d1/\epsilon 1S+d2/\epsilon 2S) \tag{5-1}$$

$$d=d1+d2. \tag{5-2}$$

$\epsilon 1$: Permittivity of air $\epsilon 2$: Permittivity of recording medium 6

S: Area of electrode plate d: Distance between ejecting electrode and opposite electrode d1: Thickness of space (difference between d and thickness d2 of recording medium)

d2: Thickness of recording medium

The capacitance detecting circuit 14 detects the capacitance C of the expressions (4) and (5-1) by supplying an alternating voltage between the ejecting electrode 4 and the opposite electrode 5. When the alternating voltage V (t)=V0 cos ωt (ω:alternating frequency) is supplied from the capacitance detecting circuit 14, the following equation is established:

$$RI+(1/C)\times\int IdI=V0\cos\omega t \quad (6)$$

R: inner resistance in the capacitance detecting circuit 14, the ejecting electrode 4 and the opposite electrode 5

I: alternating current

When the alternating current I is expressed by I0 cos (ωt−ϕ), the equation (6) is changed to the following equation:

$$RI0\cos(\omega-\phi)+(I0/\omega C)\sin(\omega t-\phi)=V0\cos((\omega t-\phi)+\phi)$$

$$=V0\cos\phi\cos((\phi t-\phi)-V0\sin\phi\sin((\omega t-\phi)$$

Then $RI0=V0\cos$, $I0/\omega C=-V0\sin\phi$

And then $C=(1/\omega)\times(V0/I0)^2-R^2$ (7)

Since the alternating voltage V0, frequency ω and the inner resistance R are known in advance, the capacitance detecting circuit 14 detects the current value I0 and then calculates the capacitance C of the expression (7).

The gap adjustment control circuit 15 calculates the electric field strength between the ejecting electrode 4 and the recording medium 6 based upon both the detected capacitance C from the capacitance detecting circuit 14 and parameters stored in the parameter memory 18. The gap adjustment control circuit 15, and generates the motor control signal for adjusting the gap between the ejecting electrode 4 and the opposite electrode 5 so that the detected electric field strength between the ejecting electrode 4 and the recording medium 6 is a predetermined electric field strength.

The input circuit 17 generates a changing instruction to instruct the change of the recording medium 6 to the gap adjustment control circuit 15 and the printer controller 200.

The parameter memory 18 stores the parameters relating to types of the recording media. The parameters include the permittivity of each of the recording media and the area. The parameters read by the gap adjustment control circuit 15 are selected responsive to changing instructions from the input circuit 17.

The printer controller 200 supplies the printing data D to the recording circuit 19, and supplies an adjustment starting signal H to the gap adjustment control circuit 15. When the printer controller 200 generates the adjustment starting signal H, a control mode in the printer controller 200 is changed from a printing mode to an adjustment mode, and the printing data D stops.

In response to the adjustment starting signal H, the gap adjustment control circuit 15 generates a request signal Q to the capacitance detecting circuit 14 and the circuit 14 detects the capacitance C responsive to the request signal Q. When the gap adjustment control circuit 15 finishes the control for the gap adjustment, an adjustment ending signal EN is supplied to the printer controller 200. Then the printer controller 200 changes from the adjustment mode to the printing mode.

Figure 2A:
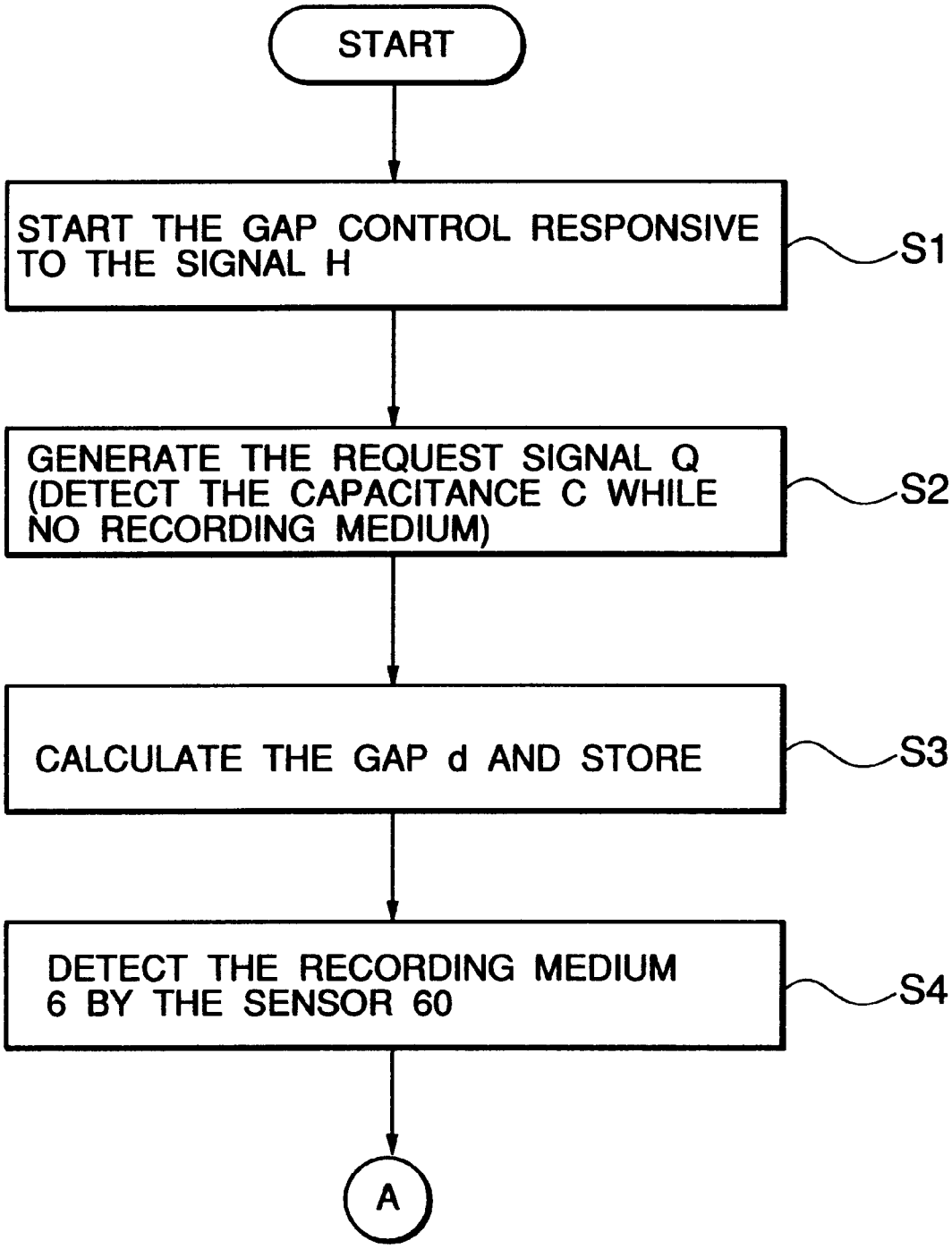
FIGS. 2A and 2B are a flowchart showing the operation of a gap adjustment control circuit of the gap adjusting device shown in FIG. 1.
Figure 2B:
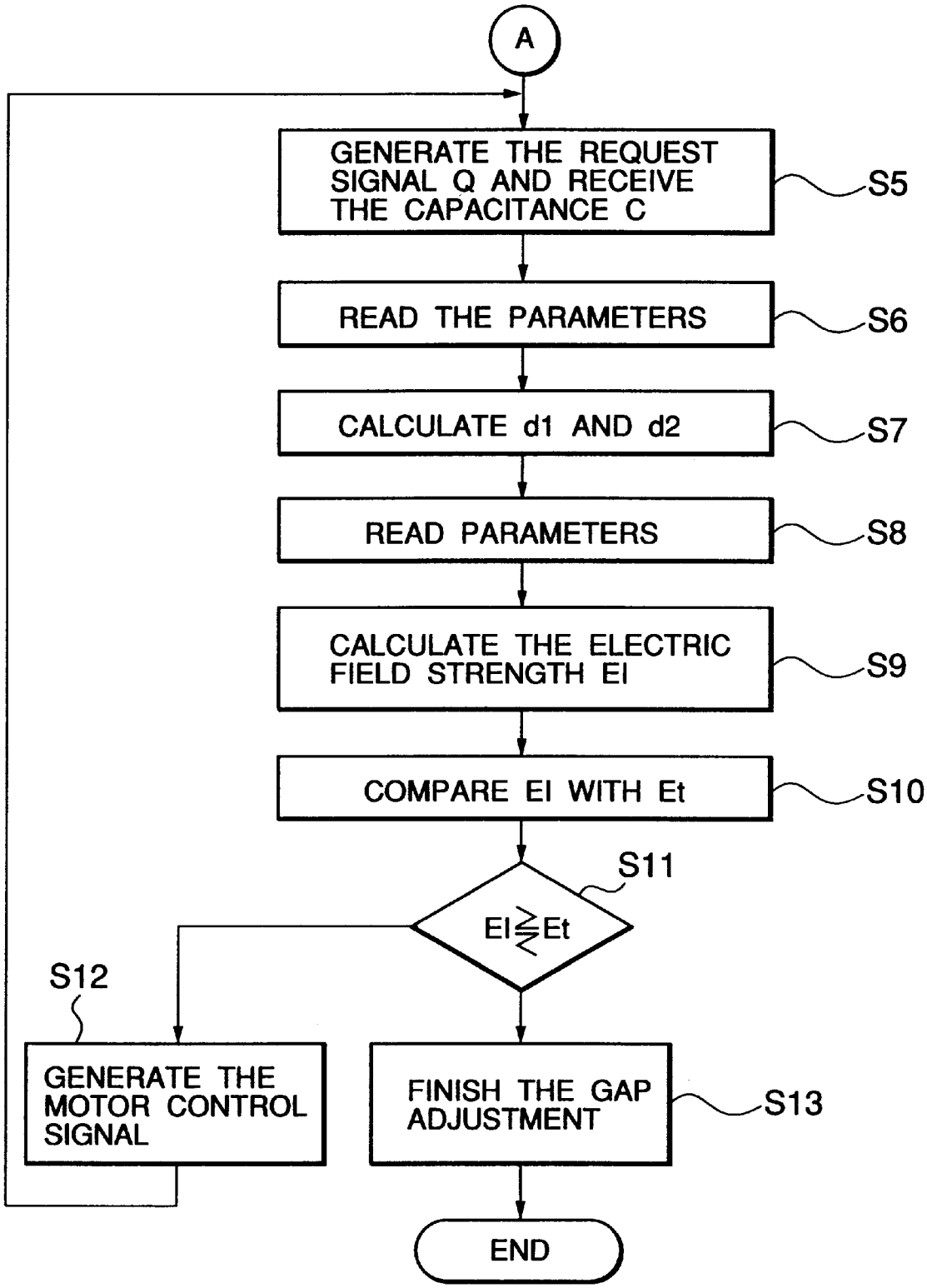

FIGS. 2A and 2B show a flowchart of a control program for the gap adjustment control circuit 15. The gap adjustment control circuit 15 is a computer circuit operated by the control program shown in FIGS. 2A and 2B. The control program is stored in read only memory (not shown) in the gap adjustment control circuit 15.

The gap adjustment control circuit 15 starts the gap adjustment control responsive to the adjustment starting signal H from the printer controller 200 (step S1). The adjustment starting signal H is generated when the initial printer data is generated or when the changing instruction is supplied from the input circuit 17. The gap adjustment control circuit 15 generates the request signal Q.

Then, to detect the gap d between the ejecting electrode 4 and the opposite electrode 5 in accordance with the expression (4), the capacitance detecting circuit 14 detects the capacitance C while no recording medium is located in the gap d (step S2). The gap adjustment control circuit 15 receives the capacitance C and calculates the gap d in accordance with the expression (4) and then the gap d is stored to the parameter memory 18 (step S3). In the calculation of the step S3, Permittivity ϵ of the air and Area S of electrode plate, that is, the area of a part of the ejecting electrode 4 opposite to the opposite electrode 5, are read from the parameter memory 18.

Next, the recording medium 6 is fed to the gap under the control of the printer controller 200 and a sensor 60 detects the recording medium 6 (step S4). When the recording medium 6 is detected, the gap adjustment control circuit 15 generates the request signal Q again, and the capacitance detecting circuit 14 detects the capacitance C which is expressed by the expression (5-1). The gap adjustment control circuit 15 receives the capacitance C from the capacitance detecting circuit 14 detected by the expression (7) as described before (step S5).

When the expressions (5-1) and (5-2) are transformed, the following expressions (8) and (9) are obtained:

$$d1=\epsilon1(\epsilon2S/C-d)\ /\ (\epsilon2-\epsilon1) \quad (8)$$

$$d2=\epsilon2(\epsilon1S/C-d)\ /\ (\epsilon1-\epsilon2). \quad (9)$$

The permittivities ϵ1 and ϵ2 and the area S of the electrode plate, that is, the area of a part of the ejecting electrode 4 opposite to the opposite electrode 5 in the above expressions, are experimentally acquired beforehand and stored in the parameter memory 18 beforehand (step S6). Hereby, the gap adjustment control circuit 15 calculates d1 and d2 based upon the expressions (8) and (9) in a step S7 by referring to capacitance C and further (step S7)), after a step S6 for reading the area S, gap d stored in the step S3 and the permittivities ϵ1 and ϵ2 respectively stored in the parameter memory 18.

Since the capacitors are connected in series, the following expressions (10) and (11) hold true:

$$\Delta V1\epsilon1S/d1=\Delta V2\epsilon2S/d2 \quad (10)$$

$$\Delta V=\Delta V1+\Delta V2. \quad (11)$$

ΔV1: Potential difference in distance of d1

ΔV2: Potential difference in distance of d2

Electric field strength E1 between the ejecting electrode 4 and the recording medium 6 is calculated based upon the above expressions as shown in an expression (12):

$$E1=\Delta V1/d1$$

$$=\Delta V/\{d1+(\epsilon1d2/\epsilon2)\}. \quad (12)$$

E1: Electric field strength in distance of d1

Potential difference ΔV in the expression (12) is stored in the parameter memory 18.

Therefore, the gap adjustment control circuit 15 calculates electric field strength E1 according to the expression (12) (step S9), based upon d1 and d2 calculated in the step S7, and the permittivities $\epsilon 1$ and $\epsilon 2$ and potential difference $\Delta V$ respectively read from the parameter memory 18 in a step S8.

Further, the gap adjustment control circuit 15 compares the calculated electric field strength E1 and reference electric field strength Et in a step S11. As a result of the comparison, when the electric field strength E1 exceeds the reference electric field strength Et, a motor control signal is generated in a step S12 so that the gap d between the ejecting electrode 4 and the opposite electrode 5 is widened. Conversely, when the electric field strength E1 is smaller than the reference electric field strength Et, a motor control signal is generated in the step S12 so that the gap d between the ejecting electrode 4 and the opposite electrode 5 is narrowed. The motor driving circuit 16 generates a driving signal to the motor 13 based upon a motor control signal from the gap adjustment control circuit 15 and drives the motor so that the gap is adjusted. Hereby, the gap is adjusted so that optimum reference electric field strength Et is kept.

As described hereinbefore, the gap adjusting device 100 constitutes a feedback group and automatically adjusts the gap based upon the capacitance C. Therefore, the steps S1 to S12 shown in FIG. 2 are repeated until the electric field strength E1 is equal to the reference electric field strength Et.

When the gap adjustment control circuit finishes the adjustment in a step S13, it generates the adjustment ending signal EN. Then, the printer controller 200 changes the control mode and supplies the printing data D to the recording circuit 19 to perform the ink jet printing operation.

Next, the gap adjusting mechanism 8 shown in FIG. 1 will be described. The print head 1 is attached on a slide guide 9 of the gap adjusting mechanism 8 in a direction in which the gap between the ejecting electrode 4 and the opposite electrode 5 is changed so that the print head can be moved. A female screw (not shown) provided on the print head 1 is coupled to the lead screw 10. The print head 1 is moved on the slide guide 9 by the feed pitch of the screw of the lead screw 10.

A lead screw gear 11 is fixed at one end of the lead screw 10. The lead screw gear 11 is engaged with a motor gear 12 and the motor gear 12 is fixed to the driving shaft of the motor 13 attached to the slide guide 9.

As described above, the capacitance detecting circuit 14 detects capacitance between the ejecting electrode 4 and the opposite electrode 5. The gap adjustment control circuit 15 calculates electric field strength in the ejecting electrode 4 after the recording medium 6 is inserted based upon a value detected by the capacitance detecting circuit 14 and sends a motor control signal to the motor driving circuit 16 so that the electric field strength is set to a preset optimum value. The motor driving circuit 16 drives the motor 13 according to the signal from the gap adjustment control circuit 15.

Hence, as electric field strength E1 in the ejecting electrode 4 after the recording medium 6 is inserted is calculated, and the gap of the print head 1 is adjusted by the gap adjustment control circuit 15 so that stable ejecting is acquired, the ejecting electric field strength and the recording quality is stable.

As the measurement of the gap between the ejecting electrode 4 and the opposite electrode 5 is realized by detecting capacitance between the ejecting electrode and the opposite electrode, the gap adjusting device can be realized at a low price without adding a special gap measuring sensor.

As the gap is electrically controlled using the detected result of the capacitance C, a simple print head gap adjusting mechanism, which is excellent in repeatability, can be realized.

In FIG. 1, the input circuit 17 may specify the type of a recording medium and specify the storage area of the parameters in the parameter memory 18 when the gap adjustment control circuit 15 calculates d1, d2 and electric field strength E1. For example, if a recording medium is standard paper, the permittivity of standard paper is read as the permittivity $\epsilon 2$ in the steps S6 and S8 shown in FIG. 2 and the permittivity according to the type of paper is specified.

It will be appreciated that modifications may be made to the invention. For example, the gap adjusting mechanism can use a cam or another moving mechanism in stead of the lead screw 10 and the lead screw gear 11 for moving the ink jet print head 1 in the direction for adjusting the gap between the ejecting electrode 4 and the opposite electrode 5. Moreover, the print head 1 can include a plurality of ink outlets 3 and a plurality of ejecting electrodes 4. In this case, the capacitance detecting circuit 14 is connected to one of the ejecting electrodes 4 and the opposite electrode 5.

Further, the ejecting electrode 3 can be located at the tip end of the ejecting outlet 3 or can be located inside the tip end near the tip end.

What is claimed is:

1. A gap adjusting device for a print head used in an ink jet recording apparatus which ejects an ink dot from said print head to a recording medium placed in a gap between an ejecting electrode formed in said print head and an opposite electrode by supplying an electric field within said gap, said device comprising:

detecting means for detecting a capacitance between said ejecting electrode and said opposite electrode; and adjusting means for adjusting said gap on the basis of a said detected capacitance detected by said detecting means.

2. The gap adjusting device according to claim 1, wherein said adjusting means comprises:

moving means for moving said print head in a direction which causes said gap to be varied, and control means for controlling said moving means on the basis of said detected capacitance.

3. The gap adjusting device according to claim 2, wherein said control means calculates an electric field strength between said ejecting electrode and said recording medium on the basis of said detected capacitance and controls said moving means such that said electric field strength achieves a desired value.

4. The gap adjusting device according to claim 3, wherein said control means further comprises:

storing means for storing parameters which are read and used for calculating said electric field strength, and means for changing said parameters in response to characteristics of said recording medium.

5. The gap adjusting device according to claim 3, wherein said detecting means detects a first capacitance between said ejecting electrode and said opposite electrode while said recording medium is not located in said gap and detects a second capacitance between said ejecting electrode and said opposite electrode while said recording medium is located in said gap.

6. A gap adjusting device for a print head used in an ink jet recording apparatus which ejects an ink dot from said print head to a recording medium placed in a gap between an ejecting electrode formed in said print head and an opposite electrode by supplying an electric field within said gap, said device comprising:

moving means for moving the print head in a direction which causes said gap to be varied; and control means for controlling said moving means such that an electric field strength between said ejecting electrode and said recording medium becomes a desired value.

7. The gap adjusting device according to claim 6, wherein said control means comprises:

detecting means for detecting a detected capacitance between said ejecting electrode and said opposite electrode, and adjusting means for adjusting a movement amount of said moving means on the basis of said detected capacitance detected by said detecting means.

8. A gap adjusting device for a print head used in an ink jet recording apparatus which ejects an ink dot from the print head to a recording medium placed in a gap between an ejecting electrode formed in the print head and an opposite electrode by supplying an electric field within said gap, said device comprising:

a detecting circuit which detects a capacitance between said ejecting electrode and said opposite electrode;

a moving device which moves said print head in a direction which causes said gap to be varied; and a control circuit which controls said moving device to vary said gap on the basis of said detected capacitance detected by said detecting circuit.

9. The gap adjusting device according to claim 8, wherein said control circuit calculates an electric field strength between said ejecting electrode and said recording medium on the basis of said detected capacitance and controls said moving device such that said electric field strength becomes a desired value.

10. The gap adjusting device according to claim 9, wherein said control circuit further comprises:

a memory which stores parameters which are read and used in calculating said electric field strength, and an input circuit which supplies an instruction to said control circuit to change said parameters in response to a change of said recording medium.

11. The gap adjusting device according to claim 8, wherein said control circuit generates a request signal for causing said detecting circuit to detect said detected capacitance.

12. The gap adjusting device according to claim 11, wherein said detecting circuit detects a first capacitance between said ejecting electrode and said opposite electrode while said recording medium is not located in said gap and detects a second capacitance between said ejecting electrode and said opposite electrode while said recording medium is located in said gap.

13. The gap adjusting device according to claim 8, wherein said control circuit controls said moving device to vary said gap before said print head records on said recording medium.

14. A method for adjusting a gap between an ejecting electrode of a print head and an opposite electrode used in an ink jet recording apparatus, said ink jet recording apparatus ejecting an ink dot from said print head to a recording medium placed in said gap by supplying an electric field within said gap, said method comprising the acts of:

detecting a capacitance between said ejecting electrode and said opposite electrode; and adjusting said gap on the basis of said capacitance.

15. The method for adjusting a gap according to claim 14, wherein said adjusting includes the acts of:

moving the print head in a direction which causes said gap to be adjusted, and controlling a moving distance of said print head on the basis of said capacitance.

16. The method for adjusting a gap according to claim 15, wherein said controlling includes the acts of:

calculating an electric field strength between said ejecting electrode and said recording medium on the basis of said capacitance, and controlling said moving distance such that said electric field strength achieves a desired value.

17. The method for adjusting a gap according to claim 16, wherein:

said capacitance comprises a first capacitance between said ejecting electrode and said opposite electrode while said recording medium is not located in said gap and a second capacitance between said ejecting electrode and said opposite electrode while said recording medium is located in said gap, and wherein said electric field strength is calculated on the basis of said first and second capacitances.

* * * * *